US007134728B1

(12) United States Patent
Buhrman

(10) Patent No.: US 7,134,728 B1
(45) Date of Patent: Nov. 14, 2006

(54) MODULAR CHAIR

(76) Inventor: Gary R. Buhrman, 2518 Bopp Rd., Town & Country, MO (US) 63131

( * ) Notice: Subject to any disclaimer, the term of this patent is extended or adjusted under 35 U.S.C. 154(b) by 0 days.

(21) Appl. No.: 11/266,986

(22) Filed: Nov. 4, 2005

(51) Int. Cl.
*A47C 7/00* (2006.01)

(52) U.S. Cl. ..... 297/440.14; 297/440.23; 297/451.11

(58) Field of Classification Search ..... 297/440.14, 297/440.23, 440.22, 440.2, 451.11
See application file for complete search history.

(56) References Cited

U.S. PATENT DOCUMENTS

| | | | | |
|---|---|---|---|---|
| D44,562 | S | 8/1913 | Haase | |
| D46,770 | S | 12/1914 | Haase | |
| 2,486,987 | A | 11/1949 | Scarlett | |
| 3,467,433 | A | 9/1969 | Lindau et al. | |
| 3,527,497 | A | 9/1970 | Self | |
| 3,788,700 | A | 1/1974 | Wartes | |
| 4,055,924 | A | 11/1977 | Beaver, Jr. | |
| 4,140,065 | A | 2/1979 | Chacon | |
| 4,348,052 | A | 9/1982 | Roland | |
| 4,509,794 | A | 4/1985 | Roland | |
| 5,000,514 | A * | 3/1991 | Hanson | 297/440.13 |
| 5,387,027 | A | 2/1995 | Maloney | |
| 5,765,922 | A * | 6/1998 | Hsia | 297/440.1 |
| 5,921,631 | A | 7/1999 | Bush | |
| 6,109,695 | A * | 8/2000 | Kahwaji | 297/440.13 |
| 6,619,749 | B1 | 9/2003 | Willy | |
| 6,634,712 | B1 | 10/2003 | Gamble | |

* cited by examiner

*Primary Examiner*—Milton Nelson, Jr.
(74) *Attorney, Agent, or Firm*—Woodard, Emhardt, Moriarty, McNett & Henry LLP

(57) ABSTRACT

In one embodiment of the present invention, a chair assembly kit comprises at least two end pieces and at least two middle pieces including a first middle piece as a chair back and a second middle piece as a chair seat. The middle pieces each include at least two self-locking tabs, one tab each on two opposing sides. The end pieces each include at least two slots configured to receive the self-locking tabs on the middle pieces. The middle pieces selectively couple to the end pieces to form a chair, with the self-locking tabs being received in the slots and configured to selectively lock the middle pieces to the end pieces.

20 Claims, 6 Drawing Sheets

MODULAR CHAIR

FIELD OF THE INVENTION

The present invention relates to furniture and in particular to an improved modular chair.

BACKGROUND OF THE INVENTION

Modular furniture is a popular method of furnishing in places such as schools. Standard pieces of modular furniture include various components, some of which are similar, if not identical, that assemble together to form a piece of furniture, such as a chair. In the traditional arrangement, furniture, and even modular furniture, is bulky and takes up considerable space during transport, including shipment, and is thus costly to transport. Attempts to remedy this problem sometimes involve furniture kit assemblies that are difficult to assemble, often requiring one or more tools. Additionally, previous pieces often lacked the options of height adjustability and locking connecting mechanisms. There is a need for an improved modular chair assembly. Certain embodiments of the present invention address these and other needs.

SUMMARY OF THE INVENTION

In one preferred embodiment of the present invention, a chair assembly comprises at least two interchangeable end pieces and at least a first middle piece, the middle piece selectively coupling to the end pieces to form a chair. Each end piece includes at least one slot. Two opposing sides of each middle piece include at least one self-locking tab. The self-locking tabs are received in the slots and lock to prevent disengagement of the middle pieces from the end pieces.

In another preferred embodiment of the present invention, a chair assembly comprises a first end piece, a second end piece, a first middle piece, and a second middle piece. Each end piece preferably includes at least four slots. The first middle piece is positionable as a chair back and the second middle piece is positionable as a chair seat. Additionally, each of the middle pieces includes at least four self-locking tabs, two self-locking tabs each on two opposing sides of each middle piece. The middle pieces selectively couple to the end pieces to form a chair. The coupling preferably includes the two self-locking tabs on the first side of the first middle piece and the two self-locking tabs on the first side of the second middle piece being received in the four slots of the first end piece. Additionally, the coupling preferably includes the two self-locking tabs on the second side of the first middle piece and the two self-locking tabs on the second side of the second middle piece being received in the four slots of the second end piece. In certain preferred embodiments, the middle pieces are interchangeable and the end pieces are interchangeable. In certain preferred embodiments, the end pieces and the middle pieces are plastic. In certain preferred embodiments, the end pieces include multiple slots to allow for height adjustability of the middle pieces.

In yet another preferred embodiment of the present invention, a chair assembly kit comprises at least two end pieces and at least two middle pieces. The kit includes a first middle piece positionable as a chair back and a second middle piece positionable as a chair seat. Each end piece includes slots for receiving self-locking tabs positioned on the middle pieces. Each middle piece includes at least two self-locking tabs, one tab each on opposing first and second sides. The middle pieces selectively couple to the end pieces to form a chair, the coupling including the self-locking tabs received in the slots to selectively lock the middle pieces to the end pieces.

It is an object of certain embodiments of the present invention to provide an improved chair assembly.

Further objects, features and advantages of the present invention shall become apparent from the detailed drawings and descriptions provided herein.

BRIEF DESCRIPTION OF PREFERRED EMBODIMENTS

Figure 1:
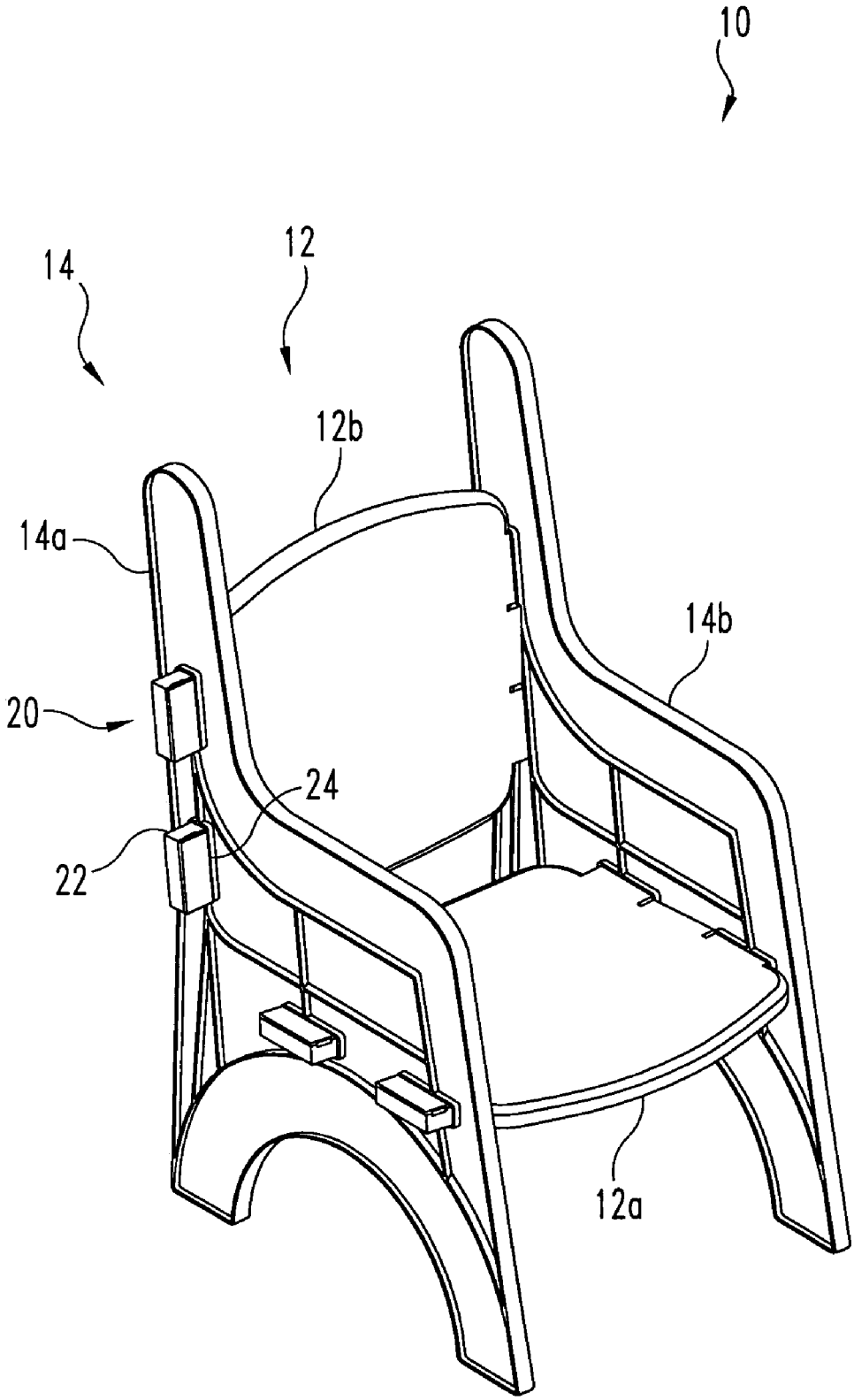
FIG. 1 is a perspective view of a preferred embodiment of the present invention.

While the present invention may be embodied in many different forms, for the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Illustrated in the accompanying figures is a modular chair assembly including connecting mechanisms. In certain embodiments, the chair assembly is a kit which can be easily shipped and assembled. In certain embodiments, the kit includes four pieces, two interchangeable end pieces and two interchangeable middle pieces, one middle piece for a chair seat and one middle piece for a chair back. The connecting mechanisms are tab and slot arrangements allowing for assembly or adjustment of the chair without the use of tools. The assembly provides for easier shipping, storage, assembly and disassembly of the chair.

In one embodiment of the present invention, a chair assembly comprises at least two end pieces and at least one middle piece. The middle pieces selectively couple via connecting mechanisms to the end pieces. In certain preferred embodiments, the connecting mechanisms are tab and slot arrangements. The middle pieces each include at least two tabs, with at least two sides of each middle piece having at least one tab. The end pieces each include at least two slots configured to receive the tabs on the middle pieces. In such embodiments, the middle pieces selectively couple to the end pieces, with the tabs being received in the slots to selectively lock the middle pieces to the end pieces. In certain embodiments, the modular chair is sized and configured to accommodate children.

FIG. 1 illustrates a modular chair 10 including middle pieces 12 connected to end pieces 14. In the illustrated embodiment, there are two middle pieces and two end pieces. The middle pieces consist of a chair seat 12*a* and a chair back 12*b*. The middle pieces are configured to selectively couple with two end pieces 14*a* and 14*b* to form the modular chair. The middle pieces are connected to the end pieces through tab and slot arrangements 20. The tab and slot arrangements connect the middle pieces to the end pieces to form the modular chair. Each arrangement 20 includes a tab 22 received in a slot 24. In certain embodiments, the tabs are configured to lock, preventing disengagement of the middle pieces from the end pieces.

Figure 2:
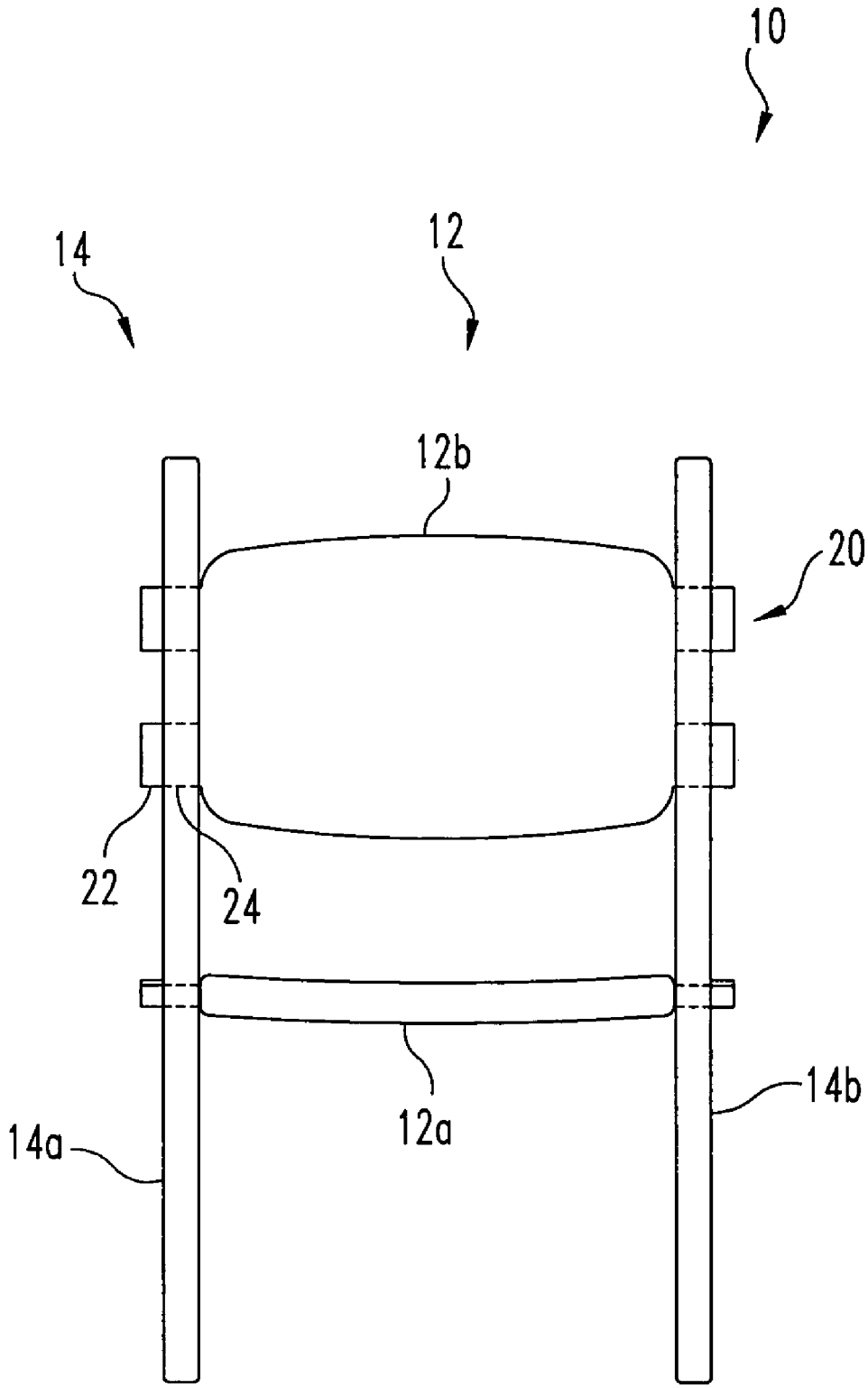
FIG. 2 is a front view of the embodiment illustrated in FIG. 1.

FIG. 2 is a front view of modular chair 10, including two middle pieces 12 and two end pieces 14. As illustrated, the chair seat and the chair back are generally perpendicular to the end pieces and generally perpendicular to each other, with chair seat 12*a* positioned generally horizontal and chair back 12*b* positioned generally vertical when the modular chair is in an upright position. In certain embodiments, chair seat 12*a* and chair back 12*b* are slightly contoured to make the modular chair more comfortable. Additionally, the end pieces 14 are positioned generally vertical when the modular chair is in an upright position. As illustrated, tabs 22 extend through slots 24 in the end pieces to connect the middle pieces to the end pieces to form the modular chair. In certain embodiments, the tabs lock to prevent disengagement of the middle pieces from the end pieces.

Figure 3A:
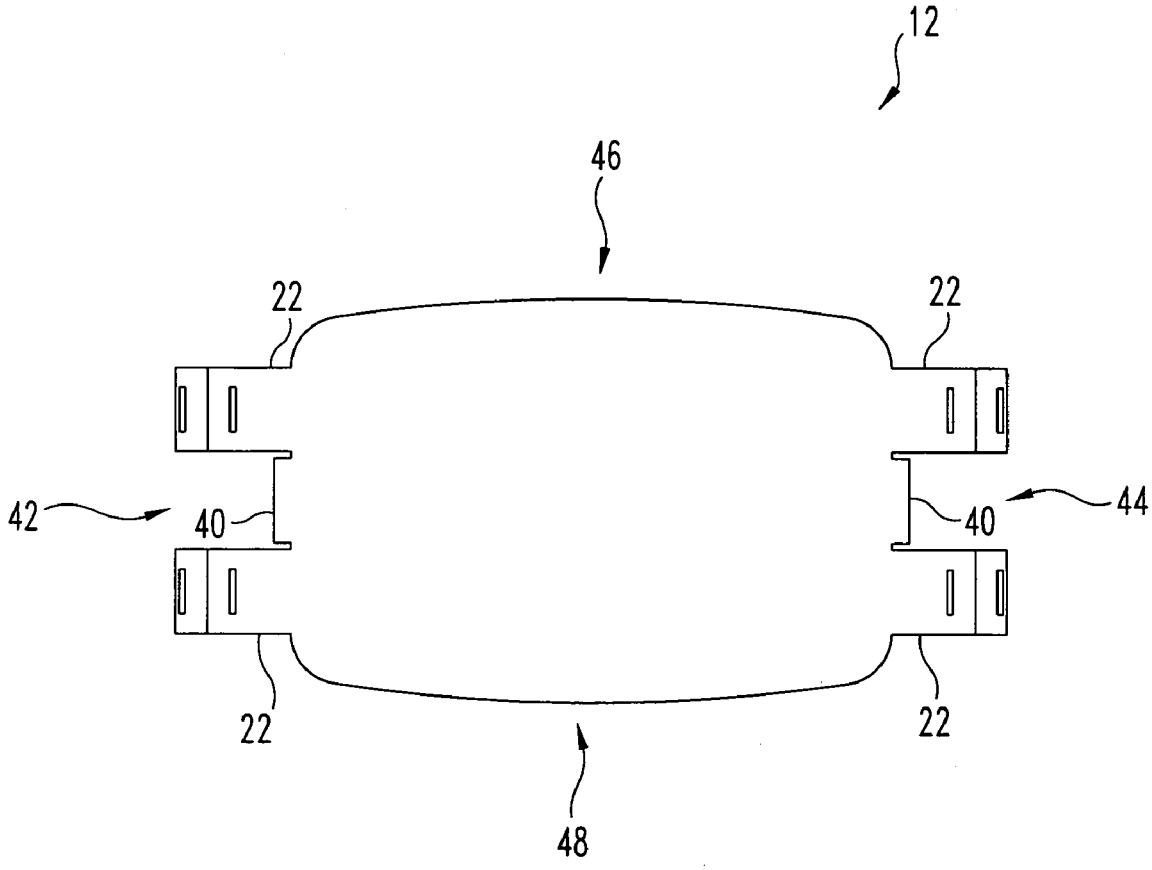
FIG. 3A is a top view of a component of the embodiment illustrated in FIG. 1.

FIG. 3A illustrates an example middle piece 12. In preferred embodiments, the middle pieces are interchangeable and identical, with the illustrated middle piece being positionable as either the chair seat or the chair back. In certain embodiments, the middle pieces are substantially similar in configuration. In less preferred embodiments, the middle pieces are different in shape and configuration.

In the illustrated embodiment, the middle piece includes two opposite sides, each having two tabs. However, it should be appreciated that the tabs can be positioned differently on the middle piece as would generally occur to one skilled in the art. In the illustrated embodiments, the middle pieces are generally rectangular in shape with curved or rounded corners. Additionally, the middle pieces are preferably of generally uniform thickness. However, it is contemplated that the middle pieces can be shaped differently as would occur to one skilled in the art.

In preferred embodiments, middle piece 12 includes two opposing sides 42 and 44, with two tabs 22 positioned on each side 42 and 44. Tabs 22 can number more or less than four per middle piece. The more tabs 22 per side of middle piece 12 and/or depending on tab spacing, generally the more stable the connection will be between the middle pieces and the end pieces. In some embodiments, the two remaining opposite sides 46 and 48 are slightly curved, as illustrated. Opposing sides 46 and 48 form a front and rear of a seat, or a top and bottom of a back, although the pieces may be reversible. In some embodiments, the curvature of sides 46 and 48 is for decorative and/or comfort purposes.

In certain embodiments, middle piece 12 includes extension portions 40 positioned between the tabs with one extension portion 40 on each side 42 and 44. In such embodiments, the extension portions encourage a flush or gap-free fit with the end pieces. In some embodiments, the tabs are permanently integrated with the middle pieces. In other embodiments, the tabs can be selectively attached to the middle pieces in a manner as would generally occur to one skilled in the art.

Figure 3B:
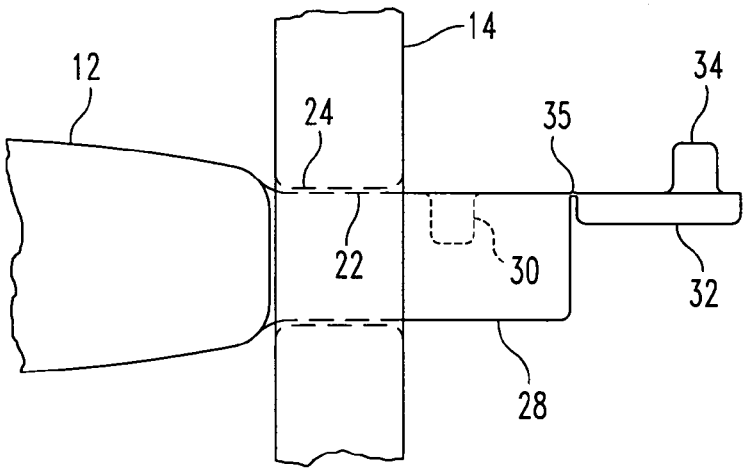
FIG. 3B is a side view of a portion of the component illustrated in FIG. 3A.

FIG. 3B illustrates a side view of a tab 22 received in a slot 24. In preferred embodiments, the outer dimension of each tab is substantially equal to or slightly smaller than the dimensions of the corresponding slot to permit insertion of the tabs in the slots. Further, in preferred embodiments, the tabs extend through the thickness of the end pieces when inserted in the slots. The tabs and slots are preferably rectangular in cross-sectional shape.

Figure 3C:
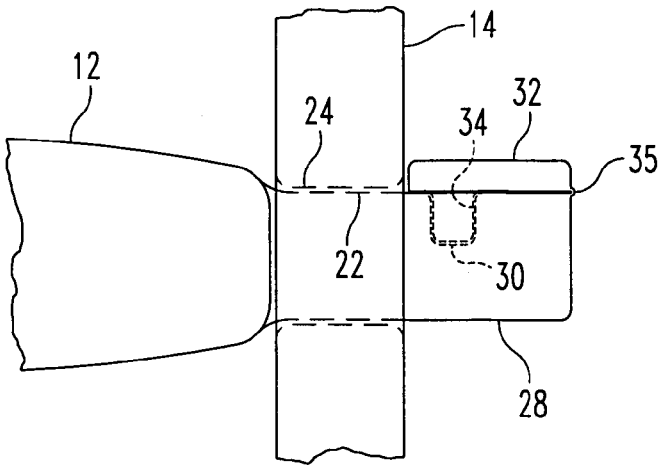
FIG. 3C is a side view of a portion of the component illustrated in FIGS. 3A and 3B.

In preferred embodiments, tabs 22 are self-locking tabs, each including a base piece portion 28, an extended flap piece 32, and a hinge 35 positioned therebetween. The base piece portion preferably includes an opening 30 and the extended flap piece preferably includes a tang 34 to be at least partially received in opening 30. The extended flap piece is configured to fold over onto the base piece portion, as illustrated in FIG. 3C, and to lock to the tab to prevent disengagement of the middle piece from the end piece. Alternately, a flap piece can fold under. In certain preferred embodiments, the tang is friction fit and/or biased and/or resilient in a manner such that the tang is encouraged to lock into a position in the opening. In certain embodiments, the tang hooks into the opening to lock the tab. In some embodiments, the tang snap fits into the opening. The flap piece can be separate; however, it is contemplated that for ease of use the extended flap piece is connected with the base piece portion.

When the flap piece is folded over to contact the base piece portion, the tab is locked and thus prevented from backing out of the slot, and thus configured to prevent disengagement of the middle piece from the end piece. In certain preferred embodiments, a cross-sectional dimension of the tab, for example the height, when the flap piece is folded over, is larger than a corresponding cross-sectional dimension of the slot. In alternative embodiments, a flap piece folds sideways to increase the width of the tab to prevent backout of the tab from the slot.

Figure 4:
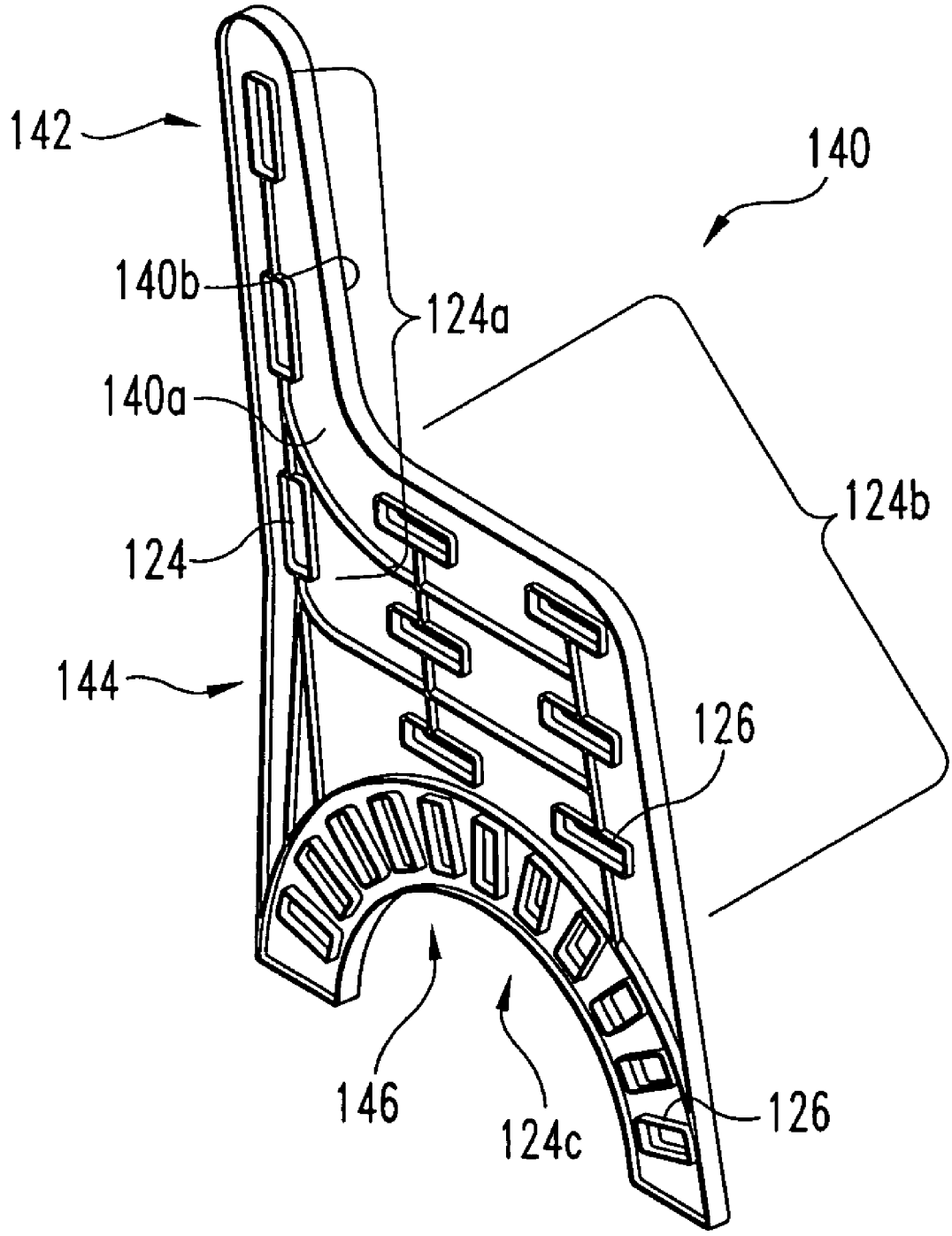
FIG. 4 is a perspective view of a component of another preferred embodiment of the present invention.

FIG. 4 illustrates an end piece 140 similar in shape and function to end pieces 14. End pieces 14 and 140 can share common characteristics such as dimensions, including width and height, shape, and material composition, to name a few examples. In some embodiments, end pieces 14 and 140 both have a generally uniform thickness.

End piece 140 includes an outer side 140*a* and an inner side 140*b* labeled here for convenience. In certain preferred embodiments, outer side 140*a* is identical to inner side 140*b*. In the illustrated embodiment (FIG. 5), the inner sides are contacting the middle pieces. End piece 140 includes an upper portion 142, a middle portion 144, and a lower portion 146. In certain embodiments, the upper portion is elongated and the lower portion includes an arcuate shape. The lower portion is preferably configured to provide support to the end piece. Slots 124 in end pieces 140 are configured to receive tabs, such as tabs 22, to connect the middle pieces, such as middle pieces 12 discussed above, to end pieces 140.

In certain preferred embodiments, slots 124 collectively include an upper slot group 124*a*, a middle slot group 124*b*, and a lower slot group 124*c*. Upper slot group 124*a* is positioned on upper portion 142, middle slot group 124*b* is positioned on middle portion 144, and lower group 124*c* is positioned on lower portion 146. Upper slot group 124*a* receives tabs on a middle portion positioned as a chair back 12*b*. Middle slot group 124*b* receives tabs on a middle portion positioned as a chair seat 12*a*. Lower slot group 124*c* can optionally receive tabs from a chair accessory or other such optional component.

In the illustrated embodiment, the upper slot group includes three slots, which allows for optional positioning of the chair back at two different positions. In the illustrated embodiment, the middle slot group includes six slots, which allows for optional positioning of the chair seat at three different positions. However, it should be appreciated that the slots can number more or less than the quantity illustrated, providing varying levels of adjustability of the middle pieces.

In certain embodiments, slots 124 include reinforcing flanges 126 extending from end pieces 140 on the interior and/or exterior sides. The flange areas can be a result of formation of the end pieces using molded plastic techniques. The flanges generally provide greater support to the end pieces and stability at the joints between the end pieces and the middle pieces. The flanges cooperate with extension portions 40 of middle pieces 12, preferably forming a flush fit between the middle pieces and the end pieces. In preferred embodiments, the flanges extend into a space between the extension portions and the tabs when the middle pieces connect to the end pieces to form a modular chair.

Slots 124 are designed to receive tabs to selectively couple the middle pieces to the end pieces. The slots are generally rectangular in shape, corresponding to the generally rectangular shape of the tabs. It is contemplated that slots and tabs of other shapes, dimensions, and configurations are possible.

Figure 5:
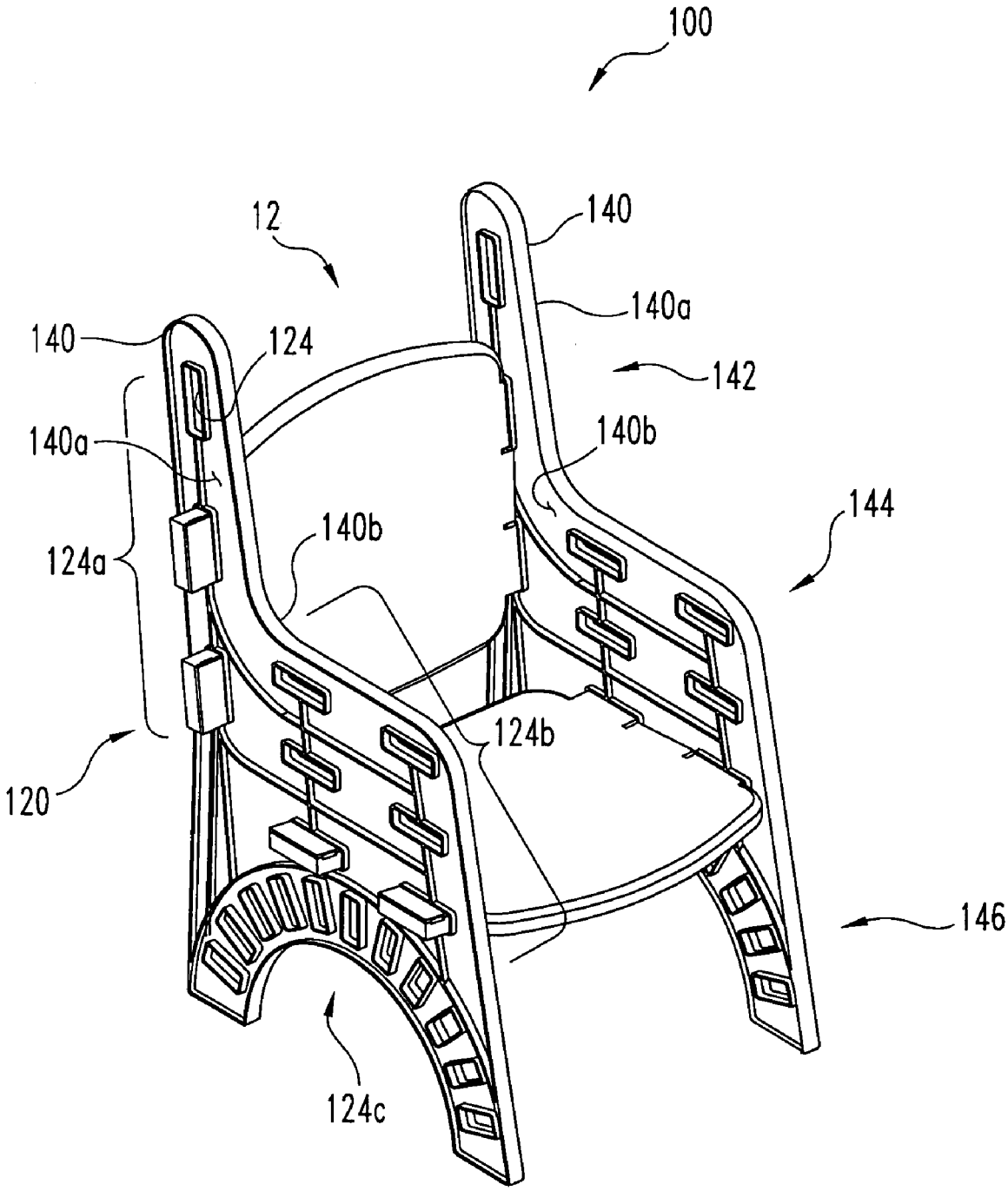
FIG. 5 is a perspective view of another preferred embodiment of the present invention.

FIG. 5 illustrates a modular chair 100 including middle pieces 12 and end pieces 140. Slots 124 in end pieces 140 cooperate with tabs on the middle portions to create tab and slot arrangements 120. Arrangements 120 are operable to selectively lock the middle pieces to the end pieces to form modular chair 100. Modular chair 100 is similar in shape, configuration and function to modular chair 10. Additionally, arrangement 120 is similar in configuration and function to tab and slot arrangement 20 previously described.

The end pieces are positioned such that the inner sides of the end pieces face the middle pieces, as illustrated. In certain embodiments, outer sides 140*a* and inner sides 140*b* are identical. The end pieces of modular chair 100 include multiple slots to allow for height adjustment of the middle pieces. In the illustrated embodiment, the chair seat can be positioned at three different height levels in conjunction with the six slots in the middle slot group, and the chair back can be positioned at two different height levels according to the three slots in the upper slot group.

In preferred embodiments, the components of the modular chairs are formed in blow-molded or injected molded plastic. In other embodiments, the components can be made from metal, rubber or other types of plastic. In less preferred embodiments, the components can be made from wood. However, it should be appreciated that other materials can be used as would generally occur to one skilled in the art. In certain preferred embodiments, the edges of the components of the modular chairs are generally rounded to protect users of the modular chairs, which can include children.

Referring general to FIGS. 1–5, the assembly of chairs 10 and 100 is described hereafter. In one preferred embodiment, a modular chair assembly is provided as a kit containing four pieces, two end pieces and two middle pieces. Alternatively, the chair assembly is provided as kit containing three pieces, two end pieces and one middle piece. The modular chair assembly provides for easier and more cost-effective shipment for example in a substantially flat package, and easier assembly of the chair, preferably without tools. In certain embodiments, the components of the modular chair assembly kit are sized to accommodate a child as a user of the chair.

The four piece kit can be assembled to form a modular chair. To assemble a modular chair such as chair 10 and chair 100, tabs disposed on the middle pieces are inserted into slots in the end pieces. In preferred embodiments, the extended flap pieces of the tabs are folded over onto the base piece portions so that the tangs connect with the openings in the base piece portions, thereby locking the tabs. Locking the tabs prevents disengagement of the tabs from the slots, such as the tabs sliding out of the slots and/or the tabs rotating within the slots. However, it should be appreciated that other appropriate mechanisms could be used to prevent backout of the tabs from the slots.

The tab and slot arrangements connect the middle pieces to the end pieces forming a modular chair without the use of tools to assemble the chair. In preferred embodiments, the arrangements are configured to lock the middle pieces to the end pieces. As previously described, the two end pieces are positioned generally vertical and parallel to each other. The chair seat is positioned generally horizontal and perpendicular to the chair back, which is positioned generally vertical. In embodiments having multiple slots, the chair seat and the chair back can be positioned at desired heights using the multiple slots.

In alternative embodiments, the middle pieces include one tab each on two opposing sides to be received in slots in the end pieces. The single tabs per side can be similar in size to the illustrated tabs 22, or smaller or wider as would occur to one skilled in the art. In alternative embodiments, the end pieces and the middle pieces are connectable to other end pieces and middle pieces to form various other types of modular furniture, including tables, desks, bookcases, and other such furniture pieces. In alternative embodiments, a kit includes three end pieces and four middle pieces, to form a piece of furniture having two chairs sharing a common end piece. In alternative embodiments, the middle pieces are wider than the illustrated middle pieces 12, to form a bench when assembled together with two end pieces.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A chair assembly, comprising:

at least two end pieces including a first end piece and a second end piece, each end piece including at least one slot, said end pieces being interchangeable; and at least a first middle piece, at least two opposing sides of said middle piece including at least one self-locking tab each, said at least two end pieces and said at least a first middle piece being plastic;

wherein said middle piece selectively couples to said at least two end pieces to form a chair, said coupling including said tabs being received and locked in said slots to connect said middle piece to said end pieces;

wherein said self-locking tabs each include a fold-over member extending from said tab and configured to fold over to selectively lock to a remainder of said tab to prevent disengagement of said tab from one of said slots.

2. The chair assembly of claim 1, wherein each of said end pieces includes a plurality of slots to allow for positioning of said middle piece at selected height levels.

3. The chair assembly of claim 1, comprising at least a second middle piece, said first and second middle pieces being interchangeable, said first middle piece being positionable as a chair back and said second middle piece being positionable as a chair seat.

4. The chair assembly of claim 3, wherein said first and second middle pieces each include at least four self-locking tabs, each piece having two tabs on an opposing side from the other two tabs.

5. The chair assembly of claim 4, wherein each of said end pieces includes a plurality of slots to allow for height positioning of each of said middle pieces.

6. The chair assembly of claim 4, wherein each of said end pieces includes at least four slots, said at least four slots receiving two of said self-locking tabs of each of said middle pieces.

7. The chair assembly of claim 1, wherein at least one of said end pieces includes a plurality of slots to allow for selective coupling to at least one chair accessory.

8. The chair assembly of claim 1, wherein said at least two end pieces and said at least one middle piece are injection molded plastic.

9. The chair assembly of claim 1, wherein when said fold-over member is extended from said self-locking tab, a cross-sectional dimension of said self-locking tab is smaller than the cross-sectional dimension of said slot.

10. The chair assembly of claim 1, wherein when said fold-over member is selectively locked to the reader of said self-locking tab, a cross-sectional dimension of said self-locking tab, including said fold-over member, is larger than the cross-sectional dimension of said slot.

11. A chair assembly, comprising:

at least two end pieces including a first end piece and a second end piece, said end pieces being interchangeable, each end piece including at least four slots; and at least two middle pieces including a first middle piece positionable as a chair back and a second middle piece positionable as a chair seat, said middle pieces being interchangeable, wherein each of said middle pieces includes at least four self-locking tabs, two of said self-locking tabs each on two opposing sides;

wherein said middle pieces selectively couple to said end pieces to form a chair, said coupling including two self-locking tabs on a first side of said first middle piece and two self-locking tabs on a first side of said second middle piece being received in said slots of said first end piece, and said coupling including two self-locking tabs on a second side of said first middle piece and two self-locking tabs on a second side of said second middle piece being received in said slots of said second end piece;

wherein said at least two end pieces and said at least two middle pieces are plastic.

12. The chair assembly of claim 11, wherein said end pieces and said middle pieces are formed from injection molded plastic.

13. The chair assembly of claim 11, wherein each of said end pieces includes multiple slots to allow for different height positioning of said middle pieces.

14. The chair assembly of claim 11, wherein said self-locking tabs include a fold-over member configured to fold over and selectively lock to a remainder of said tab to prevent disengagement of said self-locking tabs from said slots.

15. A kit, comprising:

a plurality of end pieces of a chair assembly, each end piece including at least two slots; and at least two middle pieces of a chair assembly including a first middle piece positionable as a chair back and a second middle piece positionable as a chair seat, each of said middle pieces including at least two self-locking tabs, one tab each on first and second opposing sides;

wherein said middle pieces selectively couple to said end pieces to form a chair, said coupling including said self-locking tabs received in said slots and configured to selectively lock said middle pieces to said end pieces;

wherein each of said plurality of slots allows for different height positioning of one of said middle pieces as a substantially horizontal chair seat.

16. The kit of claim 15, wherein at least one of said plurality of slots allows for selective coupling to at least one chair accessory.

17. The kit of claim 15, wherein each of said plurality of slots allows for different height positioning of one of said middle pieces as a substantially vertical chair back.

18. The kit of claim 15, wherein said middle pieces are interchangeable and said end pieces are interchangeable.

19. The kit of claim 15, wherein said self-locking tabs include a fold-over member configured to fold over to prevent backout of said tabs from said slots thereby selectively locking said middle pieces to said end pieces.

20. The kit of claim 15, wherein said end pieces and said middle pieces are plastic.

* * * * *